US007297186B1

(12) United States Patent
Brennan et al.

(10) Patent No.: US 7,297,186 B1
(45) Date of Patent: Nov. 20, 2007

(54) TETHERED, INFLATABLE HOLDER FOR FLOWABLE MATERIAL

(75) Inventors: Timothy Brennan, Waldorf, MD (US); Mark Wallner, Accokeek, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 110 days.

(21) Appl. No.: 10/843,651

(22) Filed: May 6, 2004

(51) Int. Cl.
*B65D 35/28* (2006.01)

(52) U.S. Cl. ..... 96/69; 96/79; 96/96; 222/105; 222/181.2; 111/63; 172/484; 172/810; 48/174; 48/178; 4/599; 4/602; 4/900; 280/730.1; 280/743.2

(58) Field of Classification Search ..... 96/69, 96/79, 96; 222/105, 181.2; 111/63; 172/484, 172/810; 48/174, 178; 4/602, 599, 900; 280/743.2, 730.1
See application file for complete search history.

(56) References Cited

U.S. PATENT DOCUMENTS

| | | | | |
|---|---|---|---|---|
| 1,288,241 | A | 12/1918 | Simrall | |
| 3,391,409 | A | 7/1968 | Gatley | |
| 4,699,613 | A | 10/1987 | Donawick et al. | |
| 4,902,304 | A | 2/1990 | Hallen | |
| 4,986,446 | A | 1/1991 | Montgomery et al. | |
| 5,570,815 | A * | 11/1996 | Ramsay | 222/95 |
| 5,636,764 | A * | 6/1997 | Bonerb | 222/95 |
| 5,638,989 | A | 6/1997 | Ophardt et al. | |
| 5,653,354 | A * | 8/1997 | Olson | 220/9.1 |
| 5,947,333 | A * | 9/1999 | Hoffmann et al. | 222/105 |
| 5,967,579 | A * | 10/1999 | Hebert | 294/74 |
| 6,251,171 | B1 | 6/2001 | Marra et al. | |
| 6,340,100 | B1 * | 1/2002 | Gill et al. | 222/105 |
| 6,390,502 | B1 * | 5/2002 | Ryan et al. | 280/743.2 |
| 6,497,156 | B2 | 12/2002 | Dageforde | |
| 2004/0206780 | A1 * | 10/2004 | Sterner et al. | 222/202 |
| 2005/0199650 | A1 * | 9/2005 | Nyhof et al. | 222/105 |
| 2005/0288114 | A1 * | 12/2005 | Meadows | 472/134 |
| 2006/0147271 | A1 * | 7/2006 | Cho et al. | 405/107 |

* cited by examiner

*Primary Examiner*—Duane Smith
*Assistant Examiner*—Minh-Chau T. Pham
(74) *Attorney, Agent, or Firm*—Fredric J. Zimmerman

(57) ABSTRACT

A flexible bag for receiving flowable material is suspended, as from a gantry, and is tethered transversely and yet has substantially free movement along three sides for complete filling. The length of the tethers may be selected to prevent complete collapse of the bag when empty, and tubular perforated members having an "H" configuration within the bag may be provided for this purpose. Auxiliary structures provide for cooling of materials provided to the bag, their diffusion on inlet to the bag, their recirculation in the bag, and their removal from the bag. Accessories for use with wet gas provide for separation of inlet liquid and drainage of condensate within the bag.

18 Claims, 4 Drawing Sheets

TETHERED, INFLATABLE HOLDER FOR FLOWABLE MATERIAL

BACKGROUND OF THE INVENTION (1) Field of the Invention

The present invention relates to dispensing, to receptacles, and to flowable material separation using a supported flexible bag.

(2) Description of the Related Art

The following ten United States patents show prior art related to the present invention:

U.S. Pat. No. 3,391,409, which issued 9 Jul. 1968 to Gatley, and U.S. Pat. No. 4,699,613, which issued 13 Oct. 1987 to Donawick et al., show relatively small, suspended, untethered flexible bags with drains centrally of their lower sides for dispensing liquids.

U.S. Pat. No. 5,638,989 issued 17 Jun. 1997 to Ophardt et al., and discloses a box-like dispenser having a collapsible bag, the bag having a central, downward outlet secured to the dispenser and an upper end tensioned or otherwise supported above the outlet.

U.S. Pat. No. 4,902,304, which issued 20 Feb. 1990 to Hallen, and U.S. Pat. No. 4,986,446, which issued 22 Jan. 1991 to Montgomery et al., disclose flexible bladder receptacles, each receptacle being supported by resting on a surface below the receptacle. The bottom of the bladder of U.S. Pat. No. 4,902,304 is flatly disposed on a concrete "anchor ring" and the bladder is secured by "restraining cables" which pass over the top of the bladder to relieve stress in the bladder material. The bladder of U.S. Pat. No. 4,986,446 is, in accordance with its claim 1, in nonattached disposition within an open top containment vessel which is installed in an elevated position.

U.S. Pat. No. 1,288,241 issued 17 Dec. 1918 to Smyth and shows an unsuspended, downwardly tethered, inflatable flexible bag for aeronautics.

U.S. Pat. No. 6,497,156 issued 24 Dec. 2002 to Dageforde and discloses bags for exhaust and dilution gases collected by pumps, no arrangements being disclosed for supporting or otherwise restraining the bags.

U.S. Pat. No. 5,038,960 issued 13 Aug. 1991 to Seery and shows a flexible bladder disposed within a storage compartment and provided with a pipe extending into the bladder for conducting flowable material.

U.S. Pat. No. 4,177,844 issued to Kuss et al. on 11 Dec. 1979 and shows a silo breather bag which communicates with the atmosphere through a flexible conduit and which is suspended by a continuous hanger strap engaged by a plurality of hooks.

U.S. Pat. No. 6,251,171 issued 18 Feb. 2003 to Tateishi et al. and discloses cooling exhaust gas before the gas enters a bag filter.

SUMMARY OF THE INVENTION

The present invention involves a flexible bag or bladder receptacle for receiving, storing, and dispensing flowable materials including gases, liquids, and particulates.

The bag, typically, has rectangular opposite sides joined in sealed relation along their edges. The bag is suspended, as from a gantry, by an upper edge, the other three edges being unrestrained to the extent that the bag can expand to the fullest possible extent when filled.

Since the bag is substantially unrestrained, except at the above-mentioned upper edge, inlet or outlet flow connections to the bag are made through this upper edge. These flow connections may be made through flexible conduits disposed at this upper edge and extended inwardly thereof to piping structure described below.

The present invention includes tethers connected to each of the opposite bag sides and extending downwardly and generally normally therefrom. The length of the tethers may be selected to provide wind stability when the bag is located outdoors. Also, the length of the tethers may be selected so that, when the bag is substantially empty, the tethers limit the minimum volume of the bag to prevent the formation of isolated pockets of material remaining in the bag when it is effectively emptied. The length of the tethers may be selected to provide both wind stability and such limitation of the minimum bag volume.

The bag may be suspended so that a lower edge of the bag slopes downwardly to a corner of the bag for drainage of material, such as condensate, from the bag through a flexible connection which does not restrain expansion of the bag.

For fluid materials which may be provided at a high rate, filling piping structure is extended within the bag and provided with openings disposed to diffuse the inlet flow for mixing, to minimize material fatigue causing movement of the bag material, and to minimize jet reactions which flex the above-mentioned conduits and cause piping strains.

As another way to limit the minimum volume of the bag and prevent the formation of isolated pockets of material remaining in the bag when it is effectively emptied, the present invention includes piping structure within the bag, typically for inlet and having an "H" configuration with side conduits disposed toward the bag sides and extending diagonally of the bag sides so that the bag sides remain somewhat spaced when the bag is substantially emptied. Openings are provided on the facing regions of the side conduits for outlet of material from the bag when the bag is at its minimum volume with the bag sides against the side conduits.

A receptacle arrangement of the present invention may include cooling spray apparatus and a separator for liquids provided to the bag, the separator having a sump for the separated liquids and recovered spray liquid. The cooling spray may be taken from the sump liquid and an inlet conduit opening thereunder may be provided to prevent reverse flow of gas supplied to the bag.

It is an object of the present invention to provide, for flowable materials, a receptacle that is economical in construction, requires a small area, and is convenient to set up and to remove.

Another object is to provide such a receptacle adapted to receive and to dispense materials that are, variously, hot, wet, and corrosive.

A further object is to provide such a receptacle which fully utilizes the available space when filled and yet retains a minimal amount of material when effectively emptied and in which any such retained material is not disposed in isolated regions.

A particular object is to provide such a receptacle which is adapted to receive such materials at a high flow rate and to then dispense the materials at a lower, controlled flow rate for processing.

Still another object is to provide such a receptacle meeting the above and other objects with a flexible bag which may be adapted for mixing of the contents, may be effectively drained, may be exposed to the weather, and in which fatigue of the bag material is minimized.

Additional objects include providing such a flexible bag receptacle adaptable for use with a variety of inlet and outlet arrangements including arrangements for diffusing inlet flow, structures to prevent complete collapse of the bag and isolated pockets of material therein on emptying, and fluid flow structures causing minimal stress to themselves and supporting structures from fluid flow reactions.

Other objects include providing such a flexible bag receptacle adaptable for use with auxiliary apparatus to control the temperature and liquid content of inlet fluids, to provide interior access for inspection and maintenance, to protect the receptacle from excessive internal pressure and vacuum, and to prevent undesired reverse flows.

Still other objects include providing receptacles which meet the above objects and which may be fully sealed from the environment and are fully effective for their intended purposes.

BRIEF DESCRIPTION OF THE DRAWINGS

These and other objects, advantages, and novel features of the present invention will be apparent from the following detailed description when considered with the accompanying drawings wherein.

DETAILED DESCRIPTION OF THE INVENTION

Figure 1:
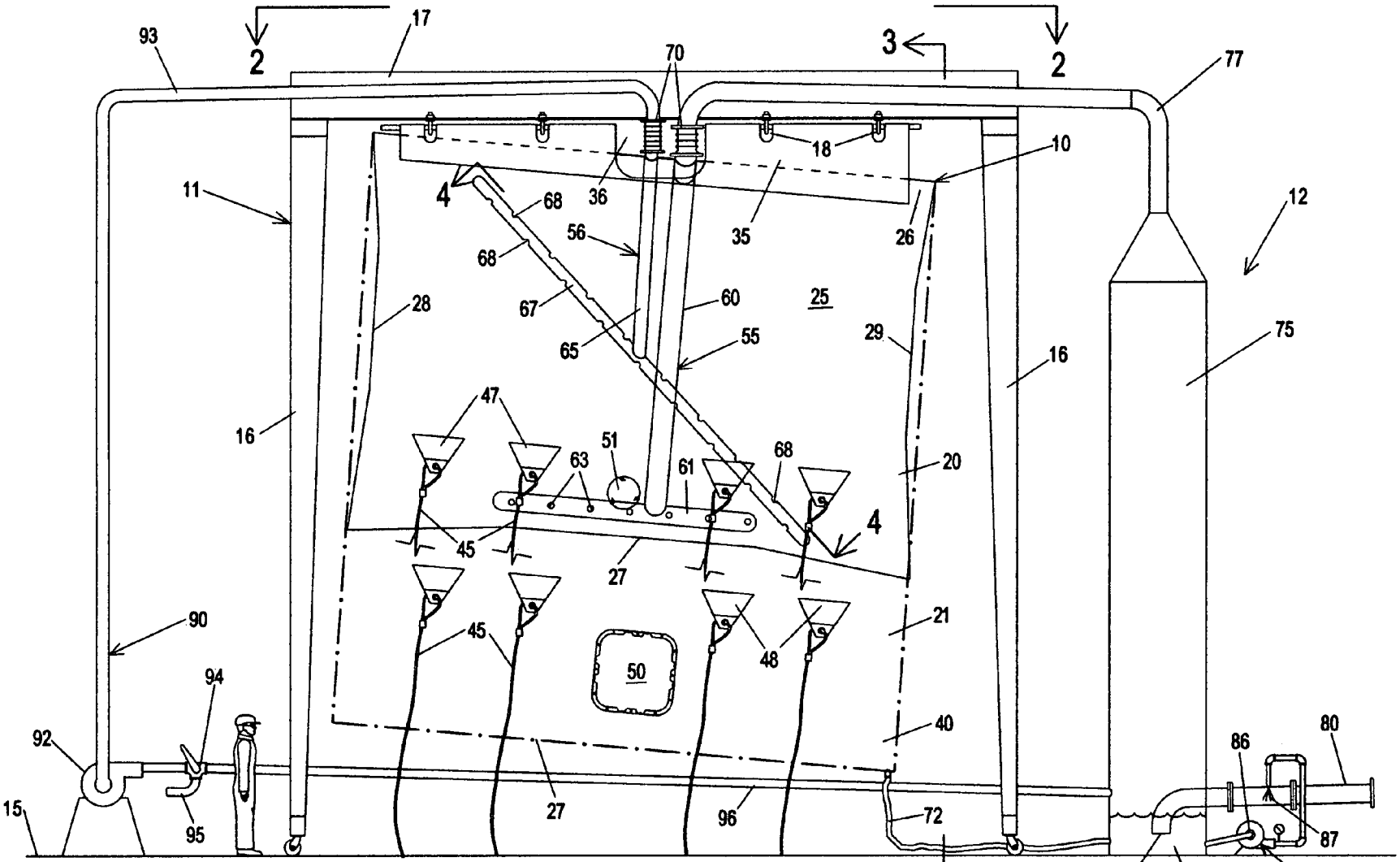
FIG. 1 is an elevation of a holder for flowable material which embodies the principles of the present invention in having a tethered, inflatable flexible bag which is shown in a filled configuration in solid lines and is shown in an empty configuration in dot-dash lines, the holder being shown with auxiliary structures for support and for use of the holder to receive hot, wet gas.
Figure 2:
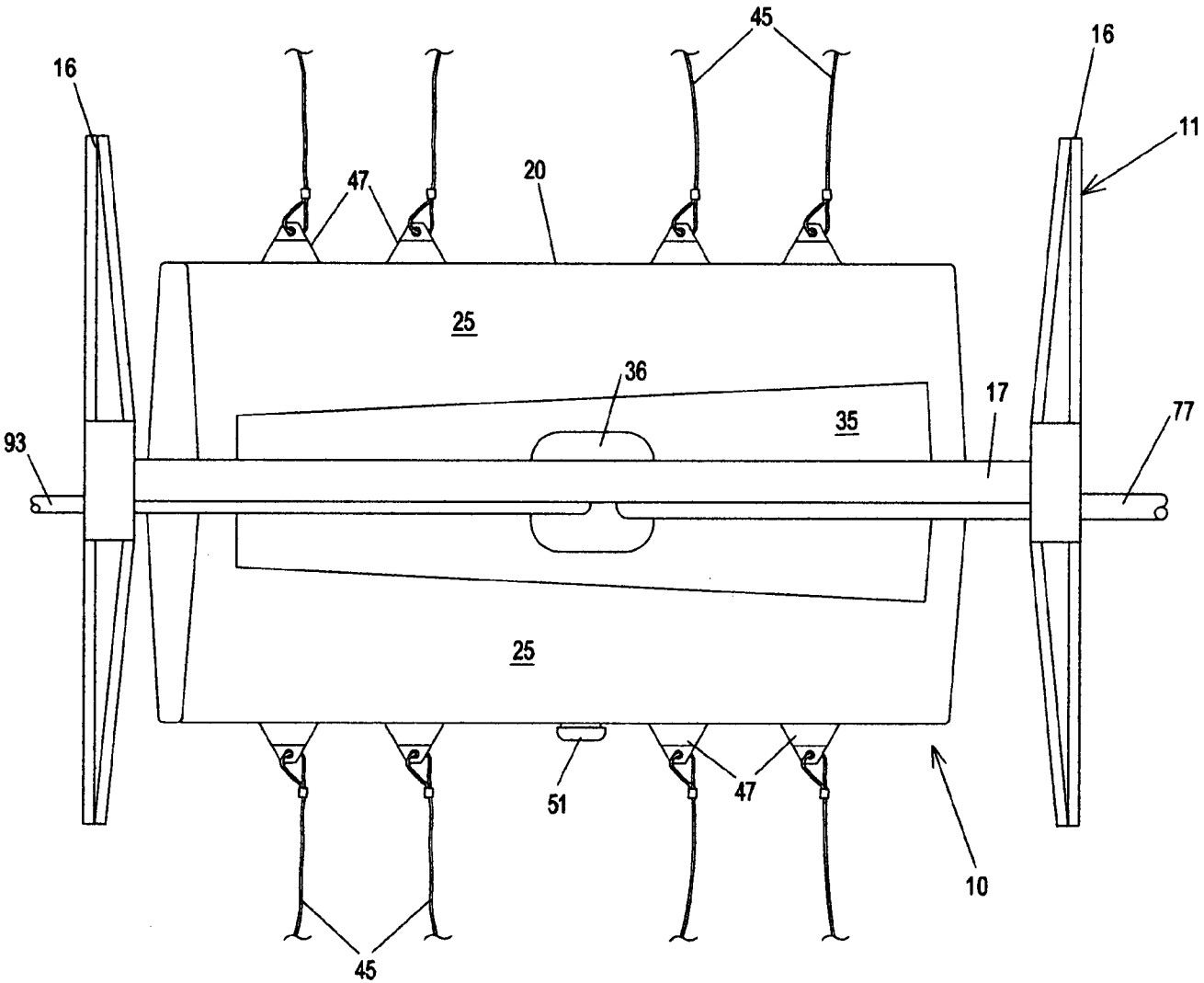
FIG. 2 is a plan view of the bag from the position of line 2-2 in FIG. 1, the bag being shown in the filled configuration and with certain of the auxiliary structures.
Figure 3:
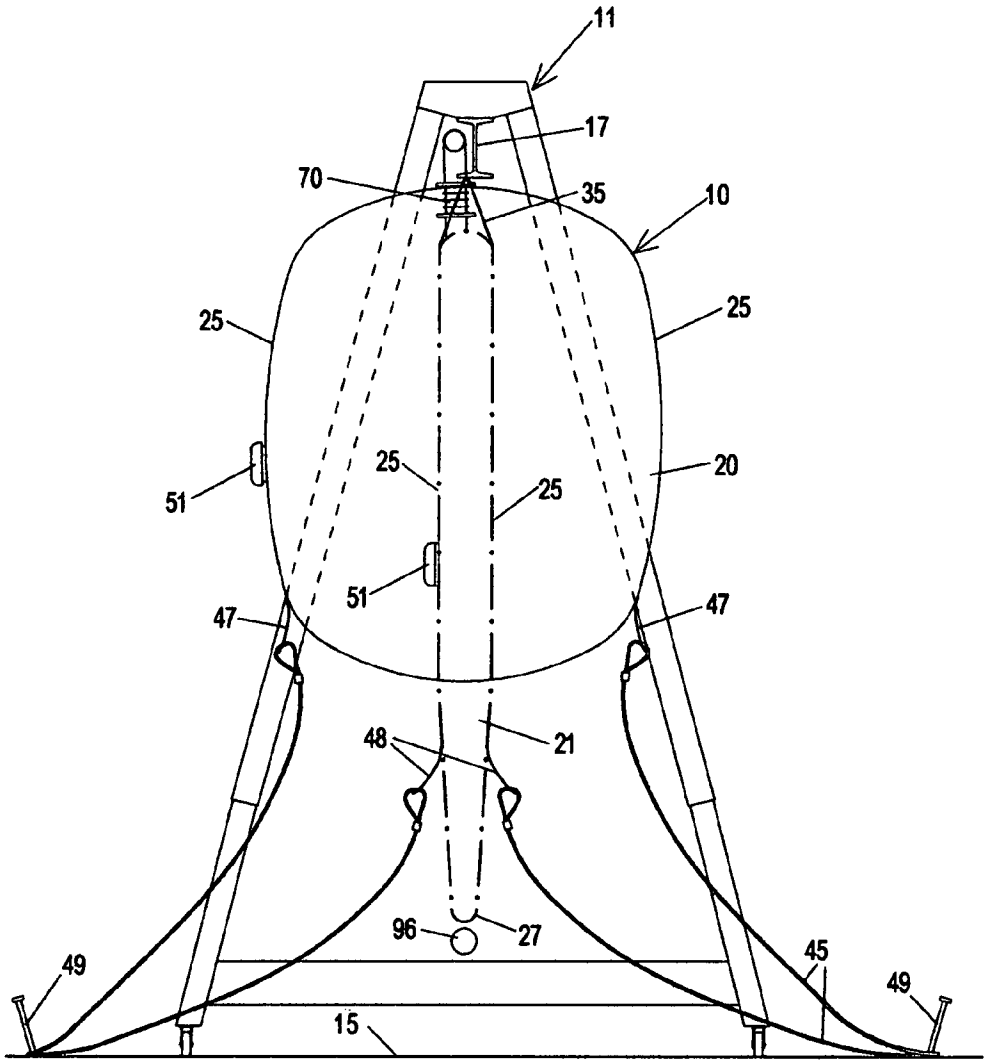
FIG. 3 is an end elevation of the bag and certain of the auxiliary structures from the position of line 3-3 in FIG. 1, the bag being shown in a filled configuration in solid lines and in an empty configuration in dot-dash lines.

Referring more particularly to the drawings, FIGS. 1 through 3 show a tethered, flexible bag and associated apparatus embodying the principles of the present invention. The depicted elements, considered generally, are those elements directly connected with the bag, which is indicated generally by the numeral 10, elements forming a gantry 11 for supporting the bag, and flow elements indicated generally by numeral 12 for providing flowable material to the bag and for circulating and removing such material from the bag.

The bag and associated apparatus are adapted to receive hot, wet, corrosive gas, as is emitted during destruction by burning of materials for rocket propulsion, explosives, and explosive devices, where such gas is generated at a rapid rate and stored in the bag for removal at a lower rate for processing. The depicted bag has a capacity of about 2000 cubic feet (56.6 cubic meters) when fully inflated and may be constructed in any suitable manner from any suitable flexible material, such as that used for military fuel storage bladders, for use with gas at temperatures ranging from ambient to about 180° F. (82° C.). Pressures in the burn chamber will range from about 3 psi (20.7 kpascals) to about 10 psi (68.9 kpascals) and will manifest in the gasholder at pressures of about 0 to about 5 inches $H_2O$ gage.

However, it will be apparent to one skilled in the art of flexible bag receptacles that, in view of the present disclosure, the principles of the present invention may be applied to receptacles of a wide range of capacities and for a variety of received materials, including but not limited to, gases and liquids of all kinds and flowable particulate solids such as those transportable by entrainment in air or other gases. It will also be apparent that, while the described embodiment of the present invention is associated with a separate inlet and outlet for the above-identified gas and with a drain for liquids associated with such gas, other embodiments of the invention may use other inlet and outlet arrangements including a single combined inlet/outlet as well as a large number of openings for different materials and their separation. These arrangements may include a variety of piping, valving, and pumping devices disposed both inside and outside of a flexible bag receptacle embodying the principles of the present invention.

Gantry 11 is a representative example of suitable structures for supporting bag 10. Such structures may be of conventional construction and may be readily assembled and erected on and removed from any suitable surface 15, such as the earth surface, where the bag is to be used. Each end of the gantry has an A-frame 16, typically provided with casters, and these frames are connected by an I-beam 17 which is provided with any suitable bag hangers 18 spaced along the I-beam.

Bag 10 has a filled configuration, which is shown in FIGS. 1 through 3 and indicated by numeral 20, and has a substantially emptied configuration which is indicated by numeral 21 and shown in FIGS. 1 and 3. It can be seen from FIG. 3 that, in end view, the bag is flattened in configuration 21 and can expand therefrom into the pillow-like form of configuration 20. As a result and in accordance with the principles of the present invention, the bag fully utilizes the available space on surface 15 on which the bag and the gantry are disposed and yet retains a minimal amount of flowable material when effectively emptied Bag 10 has opposite side panels or sides 25 which are sheet-like and generally rectangular, particularly when the bag is in its configuration 21 where sides 25 are disposed in a predetermined spaced relation for a purpose subsequently described. These sides are joined in sealed relation along their edges so that the bag, as shown in FIG. 1, has an upward edge 26 toward beam 17, an opposite lower edge 27 toward surface 15 and opposite end edges 28 and 29 toward frames 16. For purposes of exposition, edge 28 is at the left of FIG. 1 and edge 29 at the right.

Bag 10 includes a broad strap or band 35 fitted over and extending along upward bag edge 26. This band is of inverted V-shape as seen in FIG. 3. The open edges of the band are individually attached to the bag sides 25 and the closed edge of the band is connected to the hangers 18 which support the bag at its upward edge when the bag is supported from gantry 11. Centrally of its length, the band has an opening 36 for certain of the flow elements 12 which are subsequently described in detail.

It is apparent from FIGS. 1 through 3, that bag 10 is suspended from gantry 11 at the upward edge 26 of the bag and that the other three bag edges, 27 through 29 are unrestrained so that the bag can expand to the fullest possible extent when filled into its configuration 20. It is also apparent that bag lower edge 27 is relatively near surface 15 when the bag is in its emptied configuration and that this edge is raised substantially above surface 15 when the bag is in its filled configuration. It is further apparent that gantry 11 and band 35 are connected to the bag only at its upward edge.

When a bag incorporating the principles of the present invention is utilized with flowable particulates, liquids or, as with bag 10, gases which may contain liquids as droplets or condensate, band 35 may be configured, as shown in FIG. 1, so that the bag is suspended with lower edge 27 of the bag sloping downwardly for drainage toward a corner 40 of the bag.

The present invention includes a plurality of tethers 45 individually connected by loops at one end to each of the opposite bag sides 25 by triangular attachment pieces of flexible material spaced generally horizontally along the bag sides and secured thereto, the positions of these pieces in filled configuration 20 being indicated by numeral 47 and their positions in substantially emptied configuration 21 being indicated by numeral 48. From these pieces, the tethers extend downwardly in a catenary-like configuration as seen in FIG. 3; and, as seen in plan view in FIG. 2, the tethers extend transversely of the bag and generally normally from its sides 25 to any suitable anchors 49, shown in FIG. 3, which fix the opposite tether ends to surface 15. In FIG. 1, the lengths of the tethers corresponding to the positions 47 are represented fragmentarily for illustrative convenience.

In accordance with the present invention, the length of tethers 45 may be selected so that, as bag 10 empties, the tethers restrain the sides 25 so as to limit the minimum volume of the bag to that of its configuration 21 and thus prevent the formation of isolated pockets of flowable material remaining in the bag when it is effectively emptied. The lengths of the tethers 45 may also be selected to provide wind stability when the bag is located outdoors.

It will be apparent to one skilled in the art, particularly when FIG. 3 is considered, that the lengths of tethers 45 can be selected so that the tethers 45 provide both wind stability and minimum volume control. For this purpose, the anchor point 49 at surface 15 for each tether 45 is positioned so that the anchor point is the same vector distance from the corresponding filled bag tether attachment position 47 as the anchor point is from the corresponding emptied bag tether attachment position 48. Further, the anchor point positions are selected so that, during transitions of bag 10 between its filled configuration 20 and its emptied configuration 21, the tethers slacken only minimally as necessary to prevent bag damage and to allow minimal bag shifting from any winds present. When the anchor positions are so selected, the exact curvature of the tethers varies with the materials and dimensions involved, but is, typically, less downwardly than depicted in FIG. 3.

The tether 45 material may be selected by one skilled in the art. This material may be elastic, akin to bungie materials or inelastic materials, such as strap materials or cables.

Typically, a bag such as bag 10 is fitted, as at a side 25, with a removable panel 50 for access to the bag interior for inspection and maintenance and is fitted with a combined vacuum and pressure relief valve 51. Such features are well-known and are indicated in FIG. 1 in their positions occupied when the bag is in its emptied configuration 21.

The depicted flow elements 12 associated with bag 10 will now be described beginning with rigid, tubular conduits within the bag and attached directly to it at its upward edge below opening 36 in support band 35. These conduits are best shown in FIG. 1, and consist of an interior inlet structure of T-configuration, indicated generally by numeral 55, and an interior outlet structure which is indicated generally by numeral 56 and has an H-configuration shown in FIG. 4.

T-shaped inlet structure 55 has a stem 60 extending downwardly from bag upper edge 26 and transversely centrally through bag 10 to a cross arm 61 disposed at a position which is somewhat above and parallel to lower bag edge 27. This cross arm is provided with outlet openings 63 disposed for mixing of material in the bag as additional material is supplied thereto. Since, as before mentioned, the inlet flow to bag 10 is at a rapid rate, openings 63 are also disposed to diffuse the inlet flow to minimize "flapping" of the bag and resulting fatigue of its material. Openings 63 are also disposed oppositely of cross arm 61 to minimize jet reactions on structure 55 which would strain this structure and the bag at edge 26 thereof.

The depicted structure 56 is constructed in accordance with the present invention so as to determine the emptied configuration 21 and corresponding volume of bag 10 and so prevent the formation of isolated pockets of material remaining in the bag when it is effectively emptied. This structure may be used in place of or together with the above-described arrangement and disposition of tethers 45 for the same purpose. Neither of these arrangements may be utilized with a bag, corresponding to bag 10 and embodying the principles of the present invention, for purposes wherein the retention of some material in the bag when it is substantially emptied is not objectionable.

Figure 4:
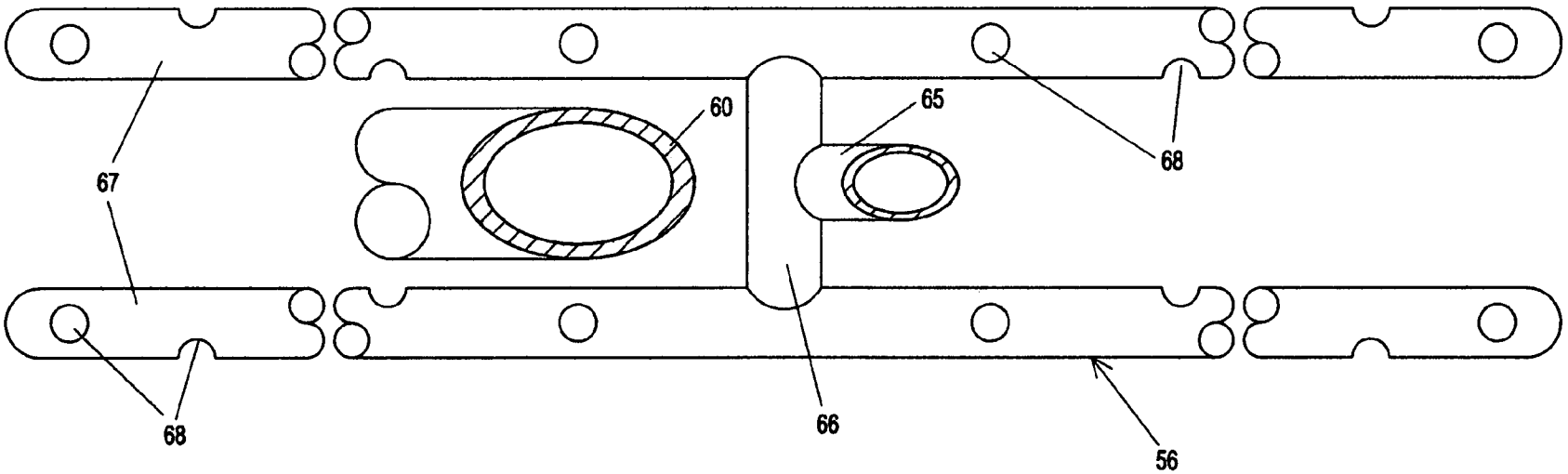
FIG. 4 is a view, from the position of line 4-4 in FIG. 1 and at an enlarged scale, of members further embodying principles of the present invention and disposed within the bag to prevent its complete collapse when empty, the members being fragmentarily and somewhat schematically represented for illustrative convenience.

As shown in FIG. 1, structure 56 has a first conduit or stem 65 extending downwardly from bag upper edge 26 and transversely centrally through bag 10 beside stem 61 of structure 55 to the center of a relatively short cross conduit 66 shown in FIG. 4. This cross conduit extends transversely between bag sides 25 to a pair of second or side conduits 67 which extend diagonally within the bag, as seen in FIG. 1, and extend oppositely of inlet structure stem 60 as seen in FIG. 4. The stem and cross conduit retain the side conduits in their disposition between the bag sides and provide flow communication between the side conduits and the exterior of the bag.

As seen in FIG. 1, conduits 67 extend generally between an upper and a lower corner of the bag when in its filled configuration 20. Conduits 67 are thus disposed between bag sides 25 so that, as may be envisioned from FIG. 3, these conduits are engaged by bag sides 25 when the bag is emptied and the bag sides remain somewhat spaced and define the substantially emptied configuration 21 of the bag.

It is apparent that structure 56 thus restrains sides 25 so as to limit the minimum volume of the bag to that of its configuration 21, and that conduits 67 are a pair of rigid members fixedly connected in a disposition wherein these conduits are between the sides 25, extend generally parallel to these sides, and are spaced transversely of the sides a distance such that engagement of the sides with said conduits maintains a portion of each side in a position corresponding to the above-mentioned and predetermined spaced relation of the sides when the bag is in the flattened configuration.

Conduits 67 are provided with a plurality of inlet openings 68 best shown in FIG. 4 and positioned along and around these conduits. As a result, such openings are provided on the facing regions of the side conduits for outlet of material from the bag when the bag is at its minimum volume and flattened configuration with the bag sides against the side conduits.

Flow connections from outside bag 10 to structures 55 and 56 are preferably made through flexible conduits 70 connected to stems 60 and 65 at bag upper edge 26 and extending upwardly therefrom through opening 36. Also, a flexible hose 72 is connected at one end thereof to bag corner 40 for a purpose subsequently described. Hose 72 is shown in FIG. 1 in its disposition corresponding to emptied bag configuration 21, it being apparent that the hose end at corner 40 will be drawn upward with flexing of the hose as the bag expands toward its filled configuration 20. It is thus apparent that, due to flexible elements 70 and 72, expansion and contraction of bag 10 is not affected by flow connections to its interior.

The depicted flow elements 12 associated with bag 10 and external thereto will now be described with reference to FIG. 1. These elements include a separation and collection tower 75 which is represented as a cylinder extending upwardly from surface 15 to a conduit 77 which connects to the one of the flexible conduits 70 associated with inlet structure 85. The lower portion of the tower is used as a liquid-containing sump 78. This sump is connected by hose 72 to bag corner 40 for drainage of any condensate or other liquid in bag 10 to the sump.

Fluids for processing by the elements shown in the Figures are provided through a main supply conduit 80 which enters tower 75 above the liquid in sump 78 and turns downwardly to an opening 82 disposed a short distance, typically a few inches, below the level of this liquid. This arrangement prevents reverse flow into conduit 80, since as before stated, the operating pressure of the depicted bag 10 is a few inches of $H_2O$ gage pressure. A plurality, not shown, of such inlet conduits may be provided for a corresponding plurality of sources of fluids for bag 10.

Tower 75 and conduit 80 are provided with a representative spray cooling or quench system 85 for hot gas and other fluids which enter the tower through this conduit. System 85 draws liquid from sump 78 by a pump 86 and discharges the liquid into conduit 80 through a spray nozzle 87. Any suitable valves and automatic controls may be used to control the flow of liquid and thus the temperature of fluids entering bag 10.

Tower 75 allows entrained droplets of liquid from system 85 to separate by gravity and not enter bag 10. These droplets thus cannot be drawn into outlet structure 86 to undesirably affect subsequent processing of gas from the bag.

Bag 10 is provided with a withdrawal and recirculation system indicated generally by numeral 90. This system is only representative of arrangements for withdrawing flowable material from a bag which corresponds to bag 10 and embodies the principles of the present invention. In other arrangements, there may only be a fluid outlet corresponding to hose 72 for dispensing of liquids from the bag. In still other arrangements, as for processing of environmentally hazardous gases, flow from the bag may be provided by processing apparatus which is directly connected to the one of the flexible conduits 70 corresponding to outlet structure 56 and which applies a vacuum to this structure.

The depicted system 90 includes a blower 92 which may be of any suitable type and have any suitable disposition, such as that shown in FIG. 1 on surface 15. A bag withdrawal conduit 93 connects the one of the flexible conduits 70 corresponding to outlet structure 56 to the blower. Fluid output from the blower goes to a three-way valve 94 which selectively provides this output to an exit conduit 95 for removal from the depicted elements or to a recirculation conduit 96. Conduit 96 conducts material from bag 10 back to tower 75. This recirculation may be to obtain additional separation of liquids in gas from the bag or may be to mix the contents of the bag for analysis or in preparation for processing when the contents are finally withdrawn via exit conduit 95.

Although the present invention has been herein shown and described in connection with what is conceived as a preferred embodiment, it is recognized that departures may be made therefrom within the scope of the invention, which is not limited to the illustrative details disclosed and which may be practiced within the scope of the following claims by using certain features of the invention to the exclusion of others.

What is claimed is:

1. A holder for flowable material, comprising:

a flexible bag comprising a predetermined upper portion and a pair of opposite side portions;

suspension structure connected to the upper portion for suspending the flexible bag above a surface; and tether structures extending transversely from each of the pair of opposite side portions for connecting each of the pair of opposite side portions to the surface other than the flexible bag.

2. The holder of claim 1, where the suspension structure is connected to the flexible bag only at the upper portion.

3. The holder of claim 1, further comprising a flow structure for introducing flowable material into the flexible bag and for removing flowable material from the flexible bag so that the flexible bag includes an expanded configuration when filled with the material and so that the flexible bag has a flattened configuration, wherein the pair of opposite side portions are juxtapositioned when the flexible bag is substantially emptied of the material.

4. The holder of claim 3, wherein the tether structures include elements including a length selected so that the elements prevent complete engagement of each one of the pair of opposite side portions with the other of the pair of opposite side portions when the flexible bag is in the flattened configuration.

5. The holder of claim 3, wherein the suspension structure and the tether structures are configured so that expansion and contraction of the flexible bag between the expanded configuration and the flattened configuration is not restrained by the suspension structure or by the tether structures.

6. The holder of claim 3, wherein the flow structure is connected to the flexible bag at the upper portion so that expansion and contraction of the flexible bag between the expanded configuration and the flattened configuration is not restrained by the flow structure.

7. The holder of claim 3, further comprising rigid elements comprising a connection to the flexible bag at the upper portion, wherein said rigid elements extend within the flexible bag from the connection, and wherein said rigid elements present a pair of opposite surfaces toward the pair of opposite side portions, the opposite surfaces are spaced so that engagement of the pair of opposite side portions with the opposite surfaces prevent complete engagement of each one of the pair of opposite side portions with the other of the side portions so as to define the flattened configuration.

8. The holder of claim, 3 wherein the flow structure comprises conduits, and wherein the conduits include rigid elements.

9. The holder of claim 3, wherein the flowable material includes a mixture of gas and liquid, and wherein the flow structure comprises separator means for separating gas and liquid in the mixture, the separator means having a sump for separated liquid, wherein the flow structure comprises an inlet conduit extending between the separator means and the flexible bag for gas separated by the separator means from the mixture, the conduit being flexibly connected to the upper portion of the flexible bag so that expansion and contraction of the flexible bag between the expanded configuration and the flattened configuration is not restrained by the inlet conduit; and wherein the flow structure comprise a drain conduit connecting the separator means and the flexible bag, the drain conduit being connected to the flexible bag downwardly of the upper portion and extending toward the sump, and the drain conduit being flexibly connected to the flexible bag so that expansion and contraction of the flexible bag between the expanded configuration and the flattened configuration is not restrained by the drain conduit.

10. A holder for flowable material, comprising:

a bag having a generally rectangular configuration, comprising an upper edge; a pair of side portions extending downwardly from the upper edge and disposed transversely of the upper edge, said pair of side portions include a flattened configuration, wherein the pair of side portions are adjacent when the bag is substantially emptied of the materials, and have an expanded configuration where the pair of side portions are spaced transversely of the upper edge when the bag is filled with the materials;

a means extending upwardly of the bag along the upper edge for suspending the bag above a predetermined surface with unrestrained flexing of the pair of side portions between the flattened configuration and the expanded configuration;

conduit structure for introducing flowable material into the bag and for removing flowable material from the bag;

flexible structure for connecting said conduit structure to the bag at the upper edge so that flexing of the pair of side portions is unrestrained between the flattened configuration and the expanded configuration; and restraint structures, wherein the restraint structures comprise at least one tether, which extends from each of the pair of side portions in a direction transverse to the upper edge toward the predetermined surface other than the bag.

11. The holder of claim 10, wherein the restraint structures engage the pair of side portions for holding the pair of side portions in a predetermined spaced relation when the bag is in the flattened configuration.

12. The holder of claim 10, wherein said at least one tether comprises one end connected to one of the pair of side portions and an opposite end anchored to the predetermined surface, and wherein said at least one tether comprises a length selected to hold a sub-portion of said pair of side portions in a position corresponding to a predetermined spaced relation when the bag is in the flattened configuration.

13. The holder of claim 10, wherein the restraint structures are a portion of the conduit structure, wherein the conduit structure comprises a first conduit extended into the bag a predetermined distance from said flexible structure, and a pair of rigid second conduits mounted on the first conduit in fluid communication with the first conduit, and wherein the pair of rigid second conduits are situated between the pair of side portions and extend generally parallel to the pair of side portions, and the pair of rigid second conduits are spaced transversely of the pair of side portions.

14. A receptacle, comprising:

a flexible bag for flowable material, wherein the flexible bag comprises a pair of opposite side panels disposed in a predetermined spaced relation when the flexible bag is substantially emptied and assumes a generally flattened configuration, and wherein the flexible bag comprises at least a pair of flexible tethers extending individually from each of the side panels in a direction transverse to the side panels toward a predetermined surface other than the flexible bag, where each of said pair of the flexible tethers comprises ends connected to the side panel, opposite anchored ends, and lengths selected so that each of said pair of the flexible tethers hold the side panels in a position corresponding to the predetermined spaced relation when the flexible bag is in the flattened configuration.

15. A receptacle, comprising:

a flexible bag for flowable materials, wherein the flexible bag comprises a pair of opposite side panels disposed in a predetermined spaced relation when the flexible bag is substantially emptied and assumes a generally flattened configuration, wherein the flexible bag comprises a pair of rigid members fixedly connected in a disposition where said pair of rigid members are situated between the side panels, extend generally parallel to the side panels, and are spaced transversely of the side panels a distance such that engagement of the side panels with said pair of rigid members maintains a portion of each side panel in a position corresponding to the predetermined spaced relation when the flexible bag is in the flattened configuration, and wherein the flexible bag comprises at least a pair of tethers where each tether individually extends from one of the pair of opposite side panels in a direction transverse to the pair of opposite side panels toward a predetermined surface other than the flexible bag.

16. The improvement of claim 15, wherein said pair of rigid members comprise a pair of conduits for the flowable material and are retained in said disposition by another conduit for the flowable material, said another conduit extend between said pair of conduits and an exterior of the flexible bag and provide flow communication between said pair of conduits and the exterior of the bag.

17. The improvement of claim 16, wherein said pair of conduits comprise facing regions disposed oppositely of the side panels, and wherein at least one of said facing regions defines at least one opening for flow communication to the interior of the flexible bag, whereby flow communication occur between the exterior of the flexible bag and the flexible bag during said engagement of the side panels with the pair of conduits when the flexible bag is in the flattened configuration.

18. The holder of claim 1, wherein one of said tether structures attached to an anchor point fixed to said surface is a same vector distance to the flexible bag when filled as well as when the flexible bag is empty.

* * * * *